US010029460B2

(12) United States Patent
Murochi

(10) Patent No.: US 10,029,460 B2
(45) Date of Patent: Jul. 24, 2018

(54) INKJET HEAD AND INKJET APPARATUS HAVING THE SAME

(71) Applicants: KABUSHIKI KAISHA TOSHIBA, Tokyo (JP); TOSHIBA TEC KABUSHIKI KAISHA, Tokyo (JP)

(72) Inventor: Nobuaki Murochi, Fuji Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/284,034

(22) Filed: Oct. 3, 2016

(65) Prior Publication Data

US 2017/0021625 A1 Jan. 26, 2017

Related U.S. Application Data

(62) Division of application No. 14/550,876, filed on Nov. 21, 2014, now Pat. No. 9,493,003.

(30) Foreign Application Priority Data

Nov. 22, 2013 (JP) ..... 2013-241648

(51) Int. Cl.
*B41J 2/045* (2006.01)
*B41J 2/14* (2006.01)

(52) U.S. Cl.
CPC .. *B41J 2/14209* (2013.01); *B41J 2002/14491* (2013.01)

(58) Field of Classification Search
None
See application file for complete search history.

(56) References Cited

U.S. PATENT DOCUMENTS

2008/0204534 A1* 8/2008 Kojima ..... B41J 2/055 347/94
2011/0216129 A1* 9/2011 Kusunoki ..... B41J 2/14209 347/68
2012/0033018 A1 2/2012 Yamamoto
2012/0044301 A1 2/2012 Yamamoto
2012/0229579 A1 9/2012 Kushida et al.

FOREIGN PATENT DOCUMENTS

JP 2006-256224 A 9/2006

* cited by examiner

*Primary Examiner* — Erica Lin
(74) *Attorney, Agent, or Firm* — Patterson & Sheridan, LLP

(57) ABSTRACT

An inkjet head includes a substrate having plural ink inlet holes arranged along a first direction and plural ink outlet holes arranged generally along the first direction such that adjacent ink outlet holes are offset along the first direction, a plurality of partitioning walls made of piezoelectric material that define pressure chambers therebetween, each of the partitioning walls disposed on the substrate and generally extending in a second direction that crosses the first direction between the ink inlet holes and the ink outlet holes, and a nozzle plate disposed on the partitioning walls and having a plurality of nozzles, each of the nozzles being arranged on one of the pressure chambers.

16 Claims, 7 Drawing Sheets

INKJET HEAD AND INKJET APPARATUS HAVING THE SAME

CROSS-REFERENCE TO RELATED APPLICATION

This application is a division of U.S. patent application Ser. No. 14/550,876, filed on Nov. 21, 2014, which claims the benefit of priority from Japanese Patent Application No. 2013-241648, filed Nov. 22, 2013, the entire contents of each of which are incorporated herein by reference.

FIELD

Embodiments described herein relate generally to an ink jet head and an inkjet apparatus having the same.

BACKGROUND

In an ink jet head, as density of nozzles becomes high, density of wirings that are provided corresponding to the nozzles also becomes high. One type of an ink jet head has a lot of ink inlet holes, and ink outlet holes are formed in a substrate, for example, in order to reduce a flow resistance of ink that is circulated through the holes. In such an inkjet head, the wirings may have to be disposed between the ink outlet holes. However, since an interval between the ink outlet holes is narrow, the wirings between the ink outlet holes have to be disposed close to each other, and short circuit may occur as a result. In addition, the wirings may need to have a certain width to reliably conduct electricity.

DETAILED DESCRIPTION

The embodiments are directed to dispose more electrode wirings between two adjacent ink circulation holes without increasing the pitch of the ink circulation holes.

According to one embodiment, an ink jet head includes a substrate having plural ink inlet holes arranged along a first direction and plural ink outlet holes arranged generally along the first direction such that adjacent ink outlet holes are offset along the first direction, a plurality of partitioning walls made of piezoelectric material that define pressure chambers therebetween, each of the partitioning walls disposed on the substrate and generally extending in a second direction that crosses the first direction between the ink inlet holes and the ink outlet holes, and a nozzle plate disposed on the partitioning walls and having a plurality of nozzles, each of the nozzles being arranged on one of the pressure chambers.

Figure 1:
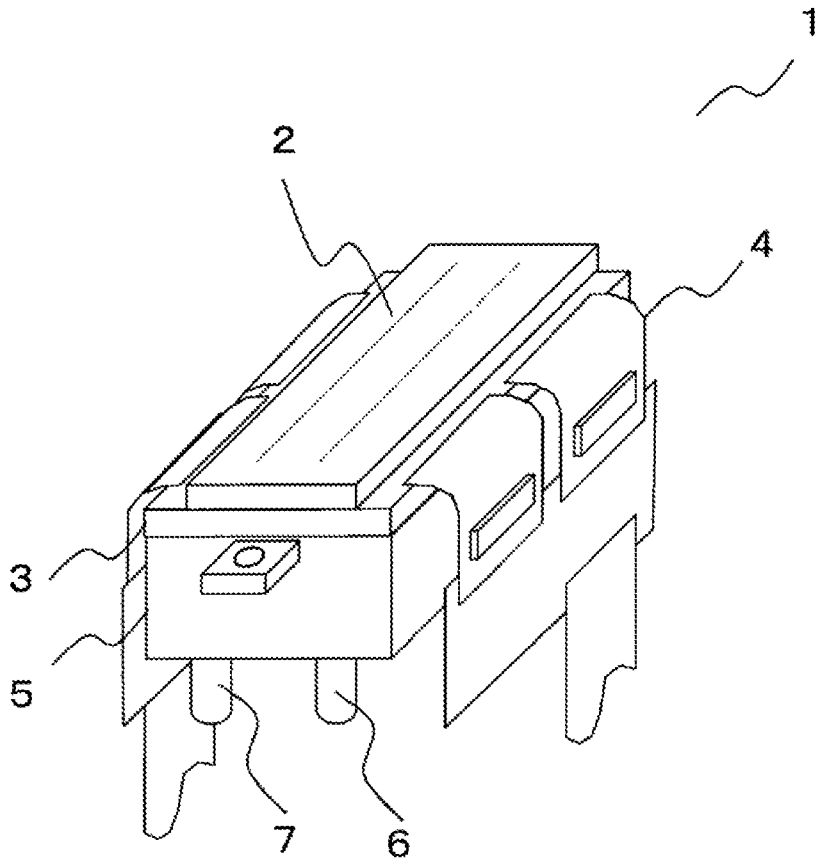
FIG. 1 is a perspective view of an ink jet head according to an embodiment.

FIG. 1 is a perspective view of an ink jet recording apparatus according to the embodiment.

An ink jet head 1 includes a head substrate 3 which includes a plurality of nozzles 2 that eject ink (ink ejecting nozzle), a driver IC 4 which generates a driving signal, and a manifold 5 which has an ink supply port 6 and an ink discharging port 7.

Each of The nozzles 2 ejects ink which is supplied from the ink supply port 6 according to a driving signal, which is generated by a drive circuit 4. Ink which flows from the ink supply port 6 and is not ejected from the nozzles 2 is discharged from the ink discharging port 7.

Figure 2:
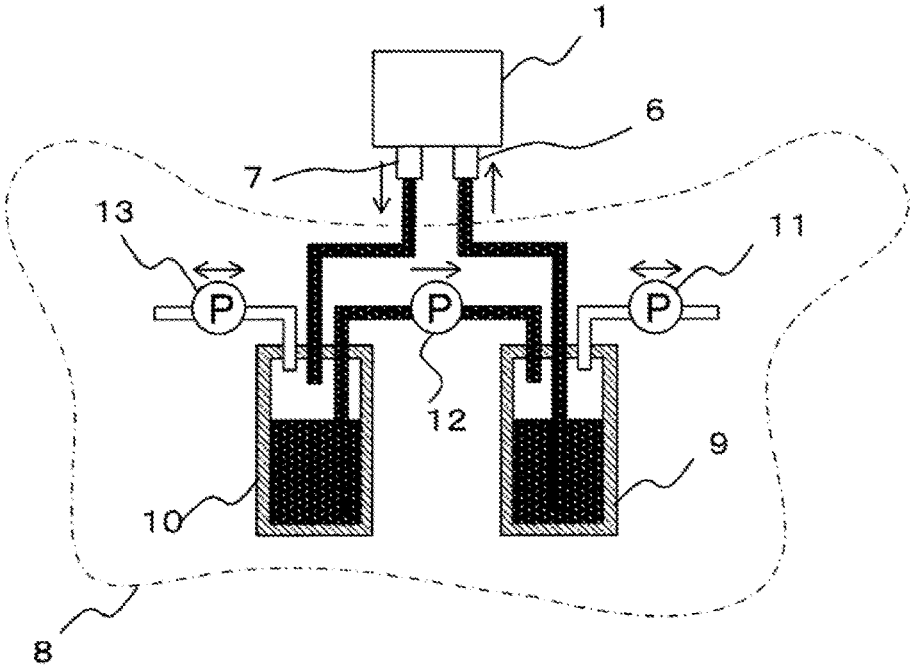
FIG. 2 is a schematic view of an ink supplying unit which supplies ink to the ink jet head according to the embodiment.

FIG. 2 is a schematic view of an ink supplying unit 8, which is used in the ink jet apparatus according to the embodiment. The ink jet apparatus is, for example, an inkjet printing apparatus. The ink supply unit 8 has an supply ink tank 9, a discharge ink tank 10, a supplied ink pressure adjusting pump 11, a transport pump 12, a discharged ink pressure adjusting pump 13, and a tube which connects these members.

The supplied ink pressure adjusting pump 11 and the discharged ink pressure adjusting pump 13 adjust a pressure of each of the supply ink tank 9 and the discharge ink tank 10, respectively. The ink in the supply ink tank 9 is supplied towards the ink supply port 6 of the ink jet head 1. The discharge ink tank 10 temporarily stores ink which is discharged from the ink discharging port 7 of the inkjet head 1. The transport pump 12 transfers the ink in the discharge side ink tank 10 to the supply side ink tank 9.

Subsequently, a configuration of the inkjet head 1 will be described in detail.

Figure 3:
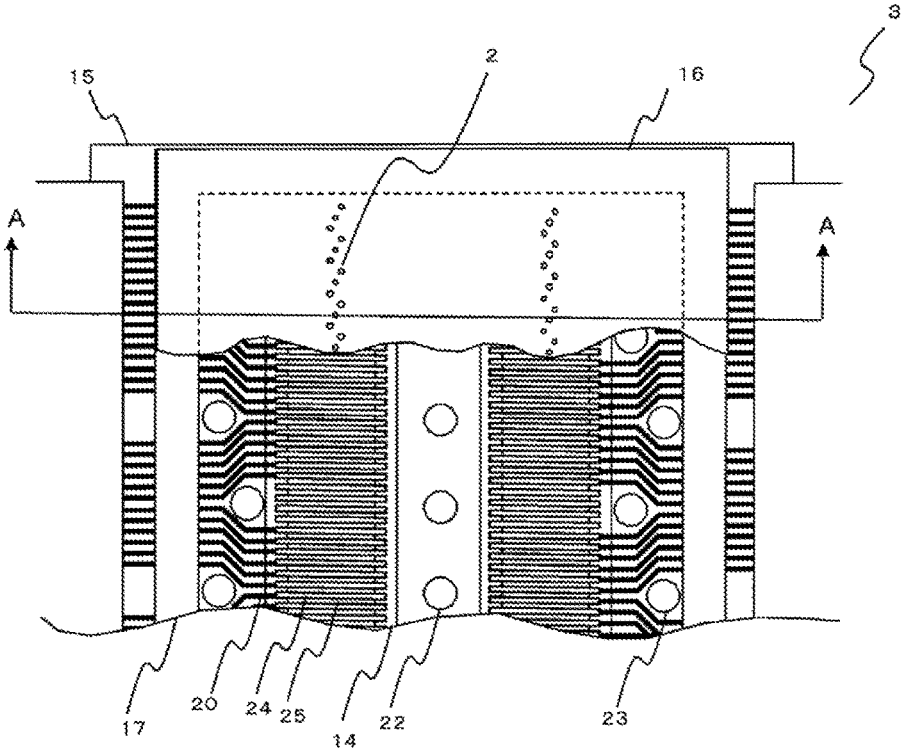
FIG. 3 is a plan view of the ink jet head according to the embodiment.
Figure 4:
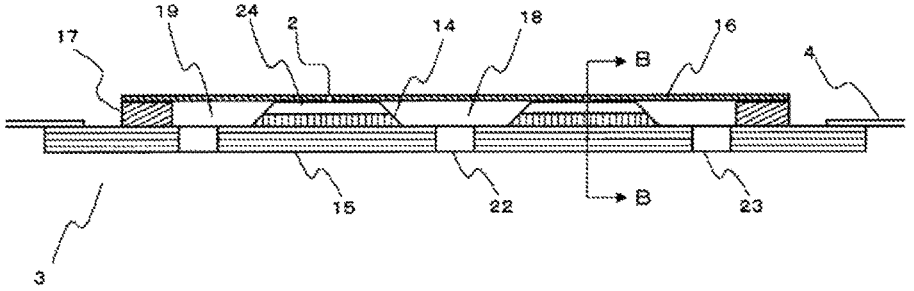
FIG. 4 is a vertical cross-sectional view of the ink jet head according to the embodiment.
Figure 5:
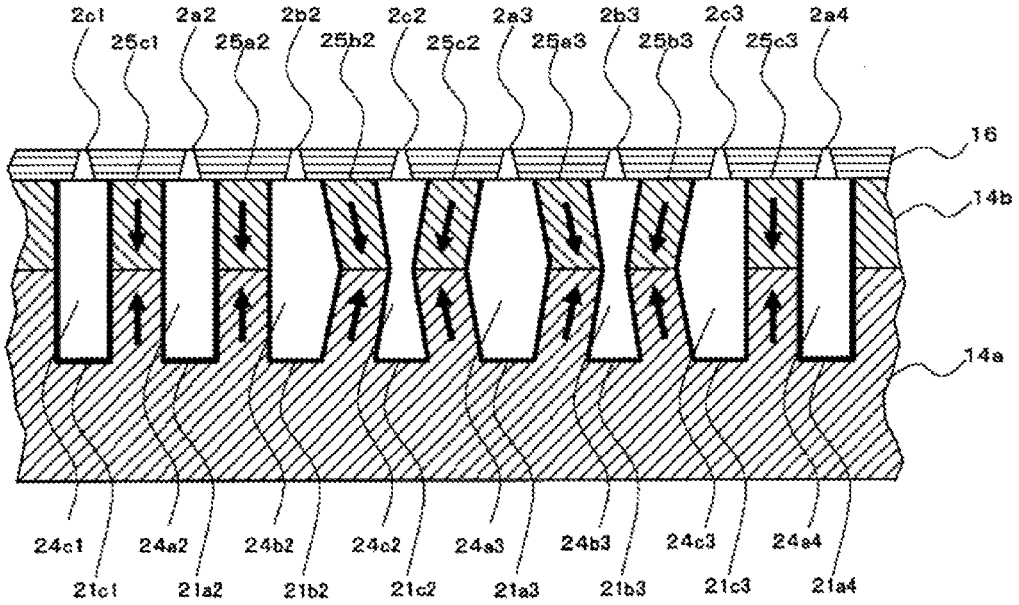
FIG. 5 is a horizontal cross-sectional view of the ink jet head according to the embodiment.

FIG. 3 is a plan view of the head substrate 3. FIG. 4 is a vertical cross-sectional view of the head substrate 3 which is taken along line A-A. FIG. 5 is a horizontal cross-sectional view of the head substrate 3 which is taken along line B-B. The head substrate 3 has a piezoelectric member 14, a base substrate 15, a nozzle plate 16, and a frame member 17. A space in a center portion, which is surrounded by the base substrate 15, the piezoelectric member 14, and the nozzle plate 16, forms an ink supply path 18. A space surrounded by the base substrate 15, the piezoelectric member 14, the frame member 17, and the nozzle plate 16 forms an ink discharge path 19.

An electrode wiring 20, which electrically connects an electrode 21 formed inside a pressurizing chamber 24 and the driver IC 4, is formed on the base substrate 15 (refer to FIG. 3).

Here, the pressurizing chamber 24 is a space between adjacent partitioning walls, and the partitioning walls are arranged in a predetermined direction so as to create the plurality of pressurizing chambers 24, each of which communicates with one of the nozzles 2 corresponding thereto, and can change a capacity of each pressurizing chamber according to a supplied driving signal.

The base substrate 15 supports the plurality of partitioning walls, has a plurality of ink inlet holes 22 so as to be disposed along one end of the partitioning walls in the arrangement direction of the plurality of partitioning walls, and has a plurality of ink outlet holes 23 which are disposed along the other end of the partitioning walls. The center portions of two adjacent ink outflow holes 23 are different from each other in a longitudinal direction of the partitioning walls.

Specifically, the ink inlet holes 22 which communicate with the ink supply path 18, and the ink outlet holes 23 which communicate with the ink discharge path 19 are formed in the base substrate 15. The ink inflet holes 22 are connected to the ink supply port 6 of the manifold 5. The ink outlet holes 23 are connected to the ink discharging port 7 of the manifold 5. It is desirable to use a material having a small dielectric constant and a small difference in a coefficient of thermal expansion with respect to the piezoelectric member. For example, as the material of the base substrate 15, it is possible to use alumina ($Al_2O_3$), silicon nitride ($Si_3N_4$), silicon carbide (SiC), aluminum nitride (AlN), lead zirconate titanate (PZT), and the like. According to the embodiment, PZT with a low dielectric constant is used.

The piezoelectric member 14 is bonded onto the base substrate 15. The piezoelectric member 14 is formed by laminating a piezoelectric member 14*a* and a piezoelectric member 14*b* of which directions are polarized in the opposite direction to each other in the plate thickness direction (refer to FIG. 5). A plurality of long grooves, which guide the ink from the ink supply path 18 to the ink discharge path 19 are formed in parallel to each other in the piezoelectric member 14, and the electrode 21 is formed at the surface of the respective long grooves. A space that is surrounded by the long groove and one face of the nozzle plate 16, which is provided on the piezoelectric member 14 and covers the long groove, forms the pressurizing chamber 24. The electrode 21 is connected to the driver IC 4 through the electrode wiring 20. The portion of the piezoelectric member 14 which configures a partitioning wall between adjacent pressurizing chambers 24 is disposed between electrodes 21 which are provided with respect to each pressurizing chamber 24, and forms an actuator 25. When an electric field is applied to the actuator 25 according to a driving signal which is generated by the driver IC 4, the actuator 25 is to a shearing deformation and formed into a "V" letter shape having a bonded portion of the piezoelectric members 14*a* and 14*b* as an apex. Due to the deformation of the actuator 25, the capacity of the pressurizing chamber 24 is changed, and ink in the pressurizing chamber 24 is pressurized. The pressurized ink is ejected from the nozzle 2. The piezoelectric member 14 is formed of lead zirconate titanate ($PZT:Pb(Zr,Ti)O_3$), lithium niobate ($LiNbO_3$), lithium tantalite ($LiTaO_3$), or the like. According to the embodiment, lead zirconate titanate (PZT) with a high piezoelectric constant is used.

The electrode 21 has a two-layered structure of nickel (Ni) and gold (Au). The electrode 21 is uniformly formed in the long groove using a plating method, for example. In addition, as a forming method of the electrode 21, it is also possible to use a sputtering method, a deposition method, in addition to the plating method. Each of the pressurizing chambers 24 has a shape with the depth of 300 μm and the width of 80 μm, and the pressurizing chambers 24 are disposed in parallel at a pitch of 169 μm.

The nozzle plate 16 is bonded onto the piezoelectric member 14. In the nozzle plate 16, plural nozzles 2 are formed at the center portion of the pressurizing chamber 24 in the longitudinal direction. The nozzles are regularly arranged at three different positions. As a material of the nozzle plate 16, it is possible to use a metallic material such as stainless steel, an inorganic material such as single crystal silicon, and a resin material such as a polyimide film. In addition, according to the embodiment, the polyimide film is used. It is possible to form the nozzles with high precision by performing hole machining using eximer laser, or the like, after bonding the nozzle plate 16 to the piezoelectric member 14. Each of the nozzles 2 has a shape which is tapered toward the ink ejection side from the pressurizing chamber side. When the material of the nozzle plate 16 is stainless steel, the nozzle 2 may be formed using press working. In addition, when the material is single crystal silicon, the nozzle 2 may be formed using dry etching, wet etching, or the like, of a photolithography method.

The ink jet head according to the embodiment is preferably applicable to the one of a share mode type or a shared wall type. In the above descriptions, the ink supply path 18 is located at one end, and the ink discharge path 19 is located at the other end of the pressurizing chamber 24, and the nozzle 2 is located at the center portion of the pressurizing chamber 24. However, the scope of the embodiment is not limited to this, and as a matter of course, the embodiment is also applicable to a configuration in which the nozzle is located at one end, and the ink supply path is located at the other end of the pressurizing chamber 24.

Figure 6:
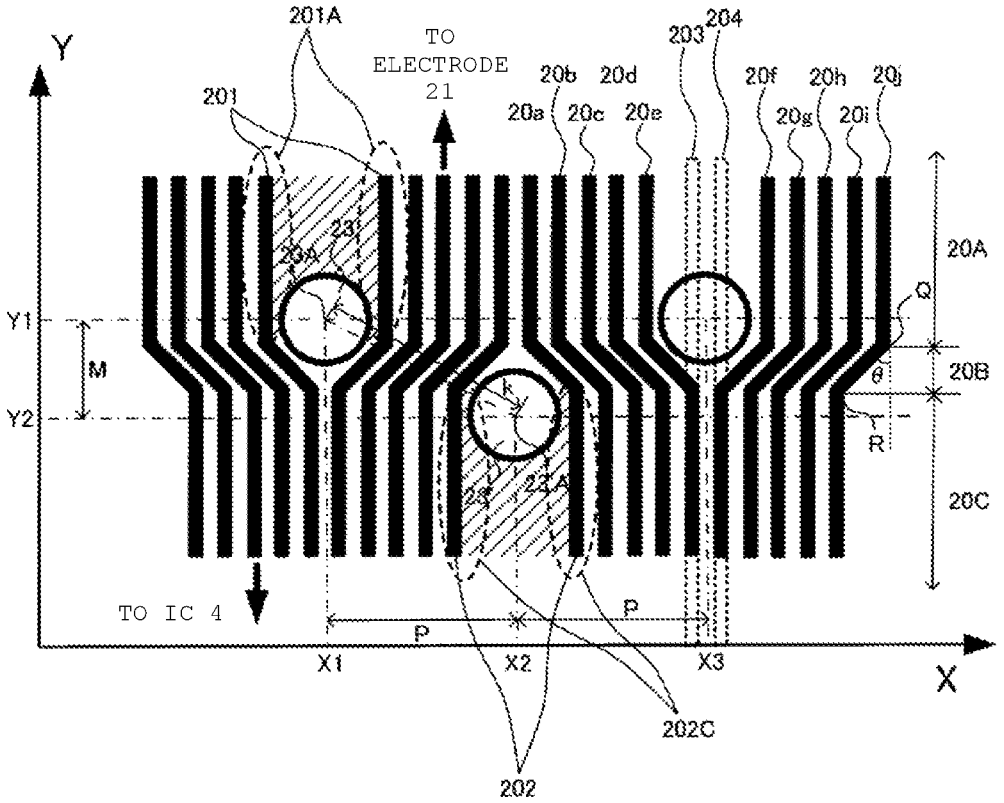
FIG. 6 illustrates a layout an ink outflow hole and electrode wiring of the ink jet head according to the embodiment.
Figure 8:
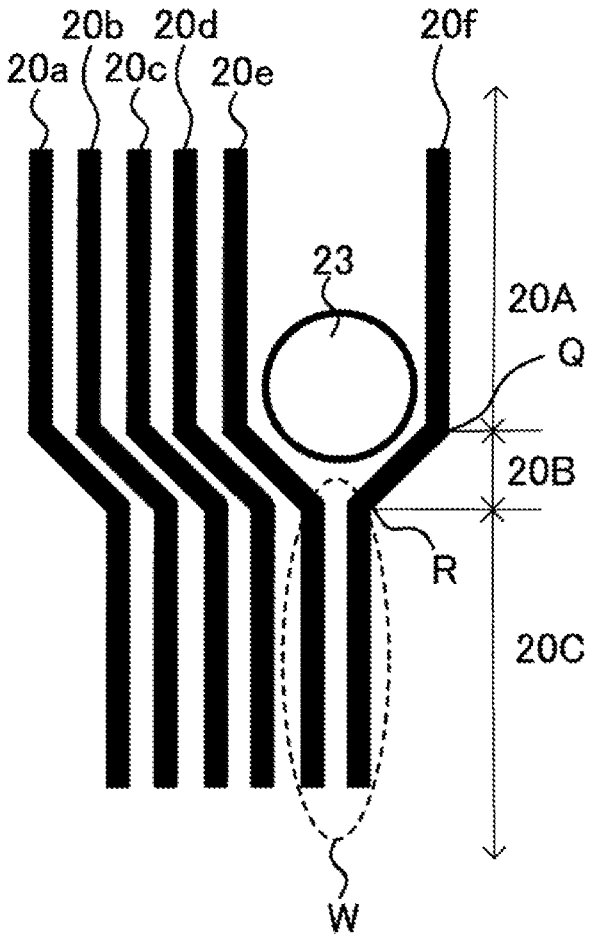
FIG. 8 is an enlarged view of the ink outflow hole and the electrode wiring of the ink jet head according to the embodiment.

FIGS. 6 and 8, respectively, illustrate a layout of the electrode wiring and ink outlet hole in the ink jet head according to the embodiment.

Figure 7:
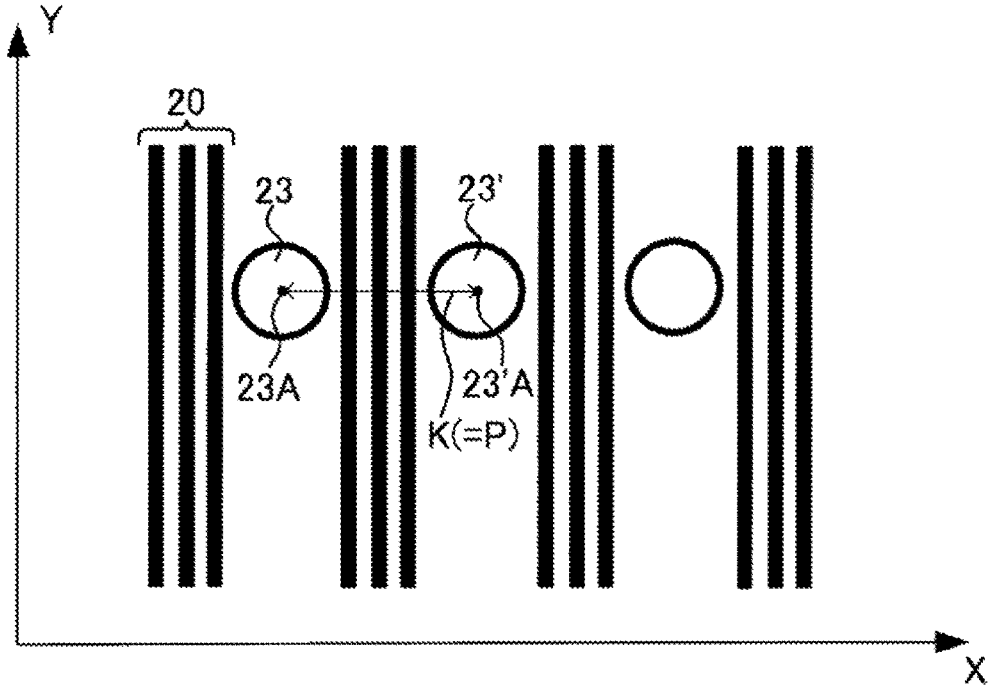
FIG. 7 illustrates a layout of an ink outflow hole and electrode wiring according to the related art.

FIG. 7 illustrates a layout of electrode wiring and an ink outlet hole in the ink jet head according to the related art.

In FIG. 6, a center position 23A of the ink outlet hole 23 is located at a position which is different from a center position 23'A of an outlet hole 23' that is adjacent thereto in the X direction (arrangement direction of piezoelectric member 14), in the Y direction (longitudinal direction of the piezoelectric member 14).

When a distance P between the center positions 23A and 23'A of the adjacent outlet holes in the X direction is constant, if the center positions 23A and 23'A of the two adjacent outlet holes are located at different positions in the Y direction, a distance k between the center positions 23A and 23'A of the two adjacent outlet holes is represented by $\sqrt{(P^2+M^2)}$ (M>0) (M is distance between center positions 23A and 23'A of the two adjacent outlet holes in Y direction).

On the other hand, as illustrated in FIG. 7, when the center positions 23A and 23'A of the adjacent outlet holes in the X direction are located at the same positions in the Y direction (when M=0), the distance k between the center positions 23A and 23'A of the adjacent outlet holes is represented by $\sqrt{(P^2+0^2)}=P$.

In this manner, when a distance P between the center positions 23A and 23'A of the adjacent outlet holes 23 and 23' in the X direction is constant, if the center positions 23A and 23'A of the adjacent outlet holes are located at different positions in the Y direction, the distance K between the center positions 23A and 23'A of the adjacent outlet holes is larger compared to a case in which the center positions 23A and 23'A of the adjacent outlet holes are located at the same position in the Y direction.

In addition, in other words, the larger the distance k between the center positions 23A and 23'A of the adjacent outlet holes, the more electrode wirings 20 it is possible to arrange between the outlet holes 23 and 23'.

In FIGS. 6 and 8, the electrode wiring 20 has a portion W that is located at one side of the ink outlet hole 23 (23A) in the longitudinal direction of the electrode wirings 201 (202), in which the ink outlet hole 23 (23A) is located, and overlaps with the ink outlet hole 23 (23A) in the X direction (arrangement direction).

Each of the electrode wirings (electrode wirings 20*a* to 20*j*) includes wiring portions 20A, 20B, and 20C, and the wiring portion 20A is continuously connected to the electrode 21, linearly extends in the Y direction from the electrode 21, and is continuously connected to the wiring unit 20B at a bent position Q. The wiring unit 20B is continuously connected to the wiring unit 20C at a bent position R, and is tilted by a predetermined angle θ with respect to a Y axis. The wiring unit 20B linearly extends while being tilted by the predetermined angle θ, and is continuously connected to the wiring unit 20C at the bent position R. The wiring unit 20C is continuously connected to the wiring unit 20B at the bent position R, linearly extends in the Y direction, and is connected to the driver IC 4.

Here, if the electrode wirings are not bent at the bent positions Q and R and linearly, the electrode wiring 20*e* would be disposed as shown by an arranging path 203, which is shown by a dot line, and electrode wiring 20*f* would be disposed as shown by an arranging path 204. That is, if the electrode wirings are linearly disposed, it would not be possible to arrange the electrode wiring 20*e* and electrode wiring 20*f* without extending over the ink outlet hole 23. On the other hand, as the center positions of the ink outlet holes according to the embodiment are located at different positions in the Y direction, and the electrode wirings are bent so as to avoid (detour) the ink outlet hole, it is possible to arrange the electrode wiring 20*e* and the electrode wiring 20*f* without extending over the ink outlet hole 23. In other words, when the ink outlet holes and the electrode wirings are arranged as in the embodiment, the electrode wirings are disposed such that the ink outlet hole are disposed therebetween, and so as to go around the ink outlet holes. As a result, it is possible to arrange more electrode wirings than the layout of the linearly arranged electrode wirings.

That is, it is possible to arrange much electrode wirings compared to the related art, by locating the center positions 23A and 23'A of the two ink outlet holes 23 and 23' that are adjacent in the X direction, at different positions in the Y direction, and arranging the electrode wirings in the bent manner.

Here, in FIG. 6, a wiring portion 201A which has the same interval as an interval of a portion of the electrode wirings that are located at the same position as the center position 23A of the ink outlet hole 23 in the longitudinal direction (Y direction), of the pair of electrode wirings 201 in which the ink outlet hole 23 is disposed therebetween, and a wiring portion 202C which has the same interval as an interval of a portion of the electrode wirings that are located at the same position as the center position 23'A of the ink outlet hole 23' in the Y direction of pair of electrode wirings 202 in which the ink outlet hole 23' that is adjacent the ink outlet hole 23 in the arrangement direction (X direction) is disposed therebetween are located at different positions in the Y direction.

In addition, in FIG. 6, in the electrode wiring, a part of one electrode wiring, and a part of the other electrode wiring which is adjacent to the electrode wiring are located at a position at which the electrode wiring overlap with each other in the X direction. In FIG. 6, for example, a part of the electrode wiring 20*f*, and a part of electrode wiring 20*g* overlap with each other in the X direction.

Figure 9:
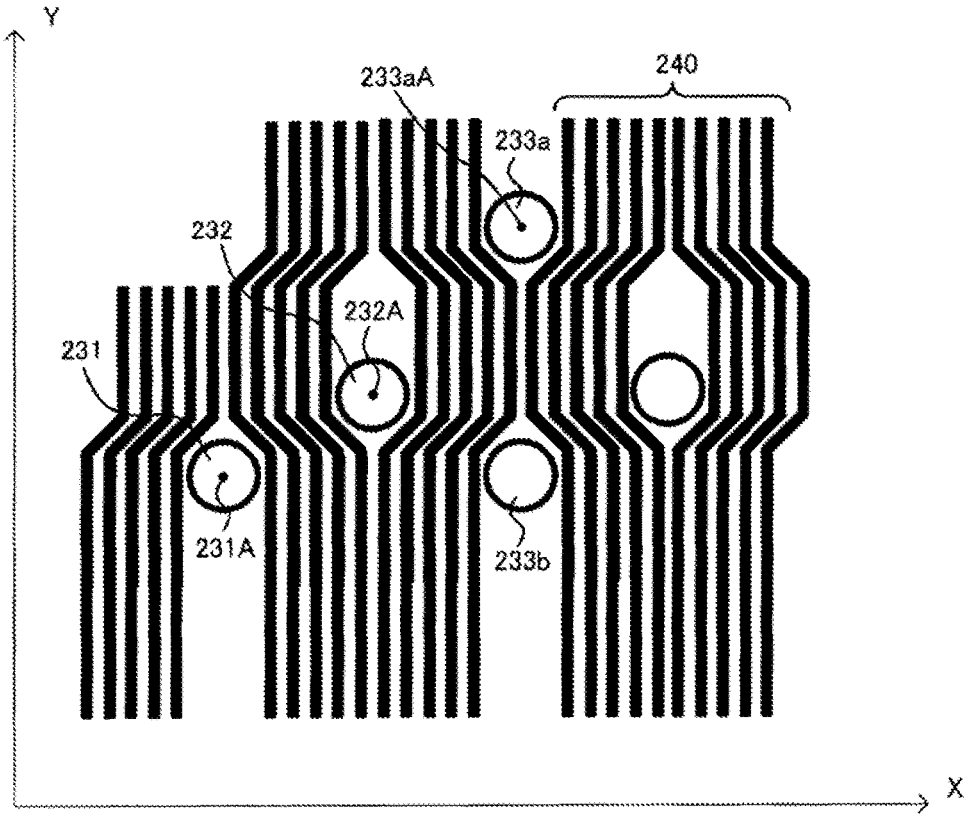
FIG. 9 illustrates a layout of the ink outflow hole and the electrode wiring of the ink jet head according to another embodiment.

FIG. 9 illustrates a layout of ink outlet holes and electrode wirings according to another embodiment.

Also in FIG. 9, positions of centers of ink outlet holes that are adjacent to each other in the X direction are different in the Y direction. However, in FIG. 9, the center positions of ink outlet holes 231, 232, and 233*a* include three different portions (three portions of ink center positions 231A, 232A, and 233*a*A) in the Y direction. With this arrangement, it is possible to arrange two ink outlet holes at an overlapped position in the X direction, as the ink outlet holes 233*a* and 233*b*. As a result, it is possible to arrange more ink outlet holes compared with the related art when the same number of electrode wirings is arranged. In other words, it is possible to arrange more electrode wirings compared with the related art when the same number of ink outlet holes is arranged.

Here, the electrode wirings according to the embodiment are bent at the bent positions Q and R; however, there is no limitation to this, and the electrode wirings may be curved, for example. That is, the electrode wirings are disposed so as to go around (detour) the ink outlet hole, and more electrode wirings may be disposed between two ink outlet holes compared to the related art.

In addition, according to the embodiment, positions in of the centers of the ink outlet holes the Y direction are the same in every other position in the X direction. However, the ink outlet hole may not be necessarily disposed in this manner, and center positions of ink outlet holes that are adjacent in the X direction may be located at different positions in the Y direction.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head comprising:

a substrate having a plurality of ink inlet holes arranged along a first direction and a plurality of ink outlet holes arranged in a staggered manner along the first direction such that adjacent ink outlet holes are offset along the first direction;

a plurality of partitioning walls made of piezoelectric material that define pressure chambers therebetween, each of the partitioning walls being disposed on the substrate and generally extending in a second direction that crosses the first direction between the ink inlet holes and the ink outlet holes;

a nozzle plate disposed on the partitioning walls and having a plurality of nozzles, each of the nozzles being arranged on one of the pressure chambers; and a plurality of wirings disposed on the substrate, each of the wirings extending from an end region of the substrate in the second direction towards one of the partition walls through a region of the substrate between two adjacent ink outlet holes, wherein two or more of the wirings pass through between each pair of two adjacent ink outlet holes, and said two or more of the wirings are entirely parallel to one another and have portions that extend in a direction different from the second direction.

2. The inkjet head according to claim 1, wherein at each of the ink outlet holes, at least two of the wirings are bent in opposite directions so that the two wirings are routed therearound.

3. The inkjet head according to claim 1, wherein each of the wirings has a bent portion between two adjacent ink outlet holes, and a distance between two adjacent wirings at the bent portions is shorter than a distance between said two adjacent wirings at portions of the wirings that are not bent.

4. The inkjet head according to claim 1, wherein alternate ones of the ink outlet holes are aligned along the first direction.

5. The inkjet head according to claim 1, wherein the plurality of ink outlet holes includes a first group of ink outlet holes arranged at a first end region of the substrate, in the staggered manner along the first direction and a second group of ink outlet holes arranged at a second end region of the substrate that is opposite to the first end region, in the staggered manner along the first direction.

6. The inkjet head according to claim 5, wherein the wirings include a first group of wirings, each extending from the first end region and having a bent portion between two of the first group of ink outlet holes that are adjacent to each other; and a second group of wirings, each extending from the second end region and having a bent portion between two of the second group of ink outlet holes that are adjacent to each other.

7. The inkjet head according to claim 6, wherein the bent portions of the first group of wirings and the bent portions of the second group of wirings are symmetrically arranged with respect to the ink inlet holes.

8. The inkjet head according to claim 5, wherein the first group of ink outlet holes is arranged at a first end region of the substrate and the second group of ink outlet holes is arranged at a second end region of the substrate that is opposite to the first end region.

9. An inkjet apparatus comprising:

an inkjet head including a substrate having a plurality of ink inlet holes arranged along a first direction and a plurality of ink outlet holes arranged in a staggered manner along the first direction such that adjacent ink outlet holes are offset along the first direction, a plurality of partitioning walls made of piezoelectric material that define pressure chambers therebetween, each of the partitioning walls being disposed on the substrate and generally extending in a second direction that crosses the first direction between the ink inlet holes and the ink outlet holes, a nozzle plate disposed on the partitioning walls and having a plurality of nozzles, each of the nozzles being arranged on one of the pressure chambers, and a plurality of wirings disposed on the substrate, each of the wirings extending from an end region of the substrate in the second direction towards one of the partition walls through a region of the substrate between two adjacent ink outlet holes; and an ink supplying unit configured to supply ink to the inkjet head through the ink inlet holes and recover ink from the inkjet head through the ink outlet holes, wherein two or more of the wirings pass through between each pair of two adjacent ink outlet holes, and said two or more of the wirings are entirely parallel to one another and have portions that extend in a direction different from the second direction.

10. The inkjet apparatus according to claim 9, wherein at each of the ink outlet holes, at least two of the wirings are bent in opposite directions so that the two wirings are routed therearound.

11. The inkjet apparatus according to claim 9, wherein each of the wirings has a bent portion between two adjacent ink outlet holes, and a distance between two adjacent wirings at the bent portions is shorter than a distance between said two adjacent wirings at portions of the wirings that are not bent.

12. The inkjet apparatus according to claim 9, wherein alternate ones of the ink outlet holes are aligned along the first direction.

13. The inkjet apparatus according to claim 9, wherein the plurality of ink outlet holes includes a first group of ink outlet holes arranged at a first end region of the substrate, in the staggered manner along the first direction and a second group of ink outlet holes arranged at a second end region of the substrate that is opposite to the first end region, in the staggered manner along the first direction.

14. The inkjet apparatus according to claim 13, wherein the wirings include a first group of wirings, each extending from the first end region and having a bent portion between two of the first group of ink outlet holes that are adjacent to each other; and a second group of wirings, each extending from the second end region and having a bent portion between two of the second group of ink outlet holes that are adjacent to each other.

15. The inkjet apparatus according to claim 14, wherein the bent portions of the first group of wirings and the bent portions of the second group of wirings are symmetrically arranged with respect to the ink inlet holes.

16. The inkjet apparatus according to claim 13, wherein the first group of ink outlet holes is arranged at a first end region of the substrate and the second group of ink outlet holes is arranged at a second end region of the substrate that is opposite to the first end region.

* * * * *